US006780211B1

(12) United States Patent
Nilsson et al.

(10) Patent No.: US 6,780,211 B1
(45) Date of Patent: Aug. 24, 2004

(54) DEVICE FOR GASIFICATION OF SPENT LIQUOR

(75) Inventors: Bengt Nilsson, Skoghall (SE); Per Alström, Karlstad (SE)

(73) Assignee: Chemrec Aktiebolag, Stockholm (SE)

( * ) Notice: Subject to any disclaimer, the term of this patent is extended or adjusted under 35 U.S.C. 154(b) by 450 days.

(21) Appl. No.: 09/959,994

(22) PCT Filed: Jun. 2, 2000

(86) PCT No.: PCT/SE00/01142

§ 371 (c)(1),
(2), (4) Date: Nov. 14, 2001

(87) PCT Pub. No.: WO00/75421

PCT Pub. Date: Dec. 14, 2000

(30) Foreign Application Priority Data

Jun. 7, 1999 (SE) ..... 9902095

(51) Int. Cl.[7] ..... D21C 11/12
(52) U.S. Cl. ..... 48/61
(58) Field of Search ..... 48/61, 62 R, 67, 48/69; 422/185, 187, 198, 202, 227, 228, 239; 162/30.1, 31

(56) References Cited

U.S. PATENT DOCUMENTS 4,808,264 A * 2/1989 Kignell ..... 162/30.1
5,407,455 A * 4/1995 Nilsson ..... 48/61
5,752,994 A * 5/1998 Monacelli et al. ..... 48/111
6,113,739 A * 9/2000 Nilsson ..... 162/30.1

FOREIGN PATENT DOCUMENTS

| | | |
|---|---|---|
| DE | 19718131 A1 | 11/1998 |
| FR | 1045048 | 11/1953 |
| WO | WO 9301890 A1 | 2/1993 |
| WO | WO 9535410 A1 | 12/1995 |
| WO | WO 9848102 | 10/1998 |

* cited by examiner

*Primary Examiner*—Samuel M. Heinrich
(74) *Attorney, Agent, or Firm*—Jeffrey S. Melcher; Manelli Denison & Selter PLLC

(57) ABSTRACT

Device for the understoichiometric gasification of spent liquor from chemical pulp production under centrifugal influence, which device comprises an upper reactor part (1), which upper reactor part is provided with an inlet (31) having a nozzle (8) for combusting the spent liquor, a separating a part (3), which is integrated with the reactor, for separating a phase, which is formed in the gasification, consisting of solid and/or molten material from a phase consisting of combustible gaseous material, and also a product liquid space (4). The separating part (3) comprises a first outlet (10) for the said phase consisting of solid and/or molten material, which outlet is arranged in connection with the lower part of the reactor part (1), in the form of a peripheral first outlet (10) which in the main follows the circumferential walls (12) of the reactor part (1), which first outlet leads to the said product liquid space (4), and also a second outlet (17) for the said phase consisting of gaseous material, which outlet is arranged in the main concentrically within the said first outlet (10).

16 Claims, 5 Drawing Sheets

DEVICE FOR GASIFICATION OF SPENT LIQUOR

TECHNICAL FIELD

The present invention relates to a device for the understoichiometric gasification of spent liquor from chemical pulp production, which device comprises an upper reactor part, which upper reactor part is provided with an inlet having a nozzle for combusting the spent liquor, a separating part for separating a phase which is formed in the gasification and consists of solid and/or multimaterial from a phase which consists of combustible gaseous material, and also a product liquid space.

STATE OF THE ART

For a very long time, the commercially dominant process for recovering energy and chemicals from so-called black liquor, obtained when producing paper pulp in accordance with the kraft method, has conventionally been the so-called Tomlinson process, which uses a so-called recovery boiler.

The Swedish patent SE-C-448 173 describes a more modern process which is based on the understoichiometric gasification/pyrolysis (i.e. with a deficit of oxygen) of the black liquor in a reactor. In this context, the products are a phase consisting of solid and/or molten material, principally comprising sodium carbonate, sodium hydroxide and sodium sulphide, and an energy-rich, combustible gas phase, principally comprising carbon monoxide, carbon dioxide, methane, hydrogen and hydrogen sulphide. The mixed solid/molten phase and gas phase are cooled and are separated from each other in a separating part, which is connected to the reactor, by means of direct contact with green liquor, with the solid/molten phase being dissolved in the green liquor.

The green liquor is then conveyed to conventional causticization for producing white liquor. The gas phase is used as fuel for generating steam and/or electric power.

WO 95/35410 and WO 96/14468 are example of further developments of the process described in SE-C-448 173. These two patent applications deal, inter alia, with the problem with regard to being able to minimize the content of bicarbonate and carbonate in the liquor which is formed, with the solutions including minimizing the contact between the gas phase which is formed in the gasification and the smelt which is generated, and, respectively, returning hydrogen sulphide to the reactor in order to displace the reaction equilibrium in the reactor.

WO 97/37944 discloses a device for what is in the main complete oxidation of a concentrated liquid, which device possesses separate extractions for a gas phase which is formed in the reactor and for a smelt phase which is generated, respectively. In this context, the gas phase is extracted from the reactor in order to be washed and cooled separately using a cooling liquid, while the smelt phase falls down into a liquid bath.

In association with the understoichiometric gasification of spent liquor, WO 93/01890 discloses drawing off a flow of smelt phase mixed with gas phase, with the two phases then being separated from each other in a separate device in the form of a cyclone. The cyclone in this context possesses a tangential inlet for the two mixed phases and a liquid film on the inner side of the walls of the cyclone, with the smelt phase dissolving in the liquid film and then flowing out from a lower outlet. The gas phase is withdrawn from the cyclone by way of an upper outlet. WO 93/01890 suffers from the disadvantage that a centrifugal effect is not initiated in the reactor, thereby reducing the efficiency of the separation.

Even if the abovementioned prior art has to some degree contributed to enabling the generated green liquor to contain less bicarbonate, it has been found that additional measures can be required in certain cases in order to avoid generated green liquor containing bicarbonate and in order to minimize the content of carbonate in the green liquor as a consequence of the generated liquor absorbing carbon dioxide from the combustion gas.

BRIEF ACCOUNT OF THE INVENTION

The present invention provides a device for the understoichiometric gasification of spent liquor, which device decreases the abovementioned problems still further or eliminates them. The device is accordingly arranged to separate smelt phase generated on gasification from generated gas phase at a superheating temperature and with contact between the gas phase and the product liquid, which is formed when the smelt phase is dissolved in an aqueous liquid, being minimized. The minimized contact and the separation at a superheating temperature result in an optimized, high proportion of hydroxide ions being obtained in the green liquor/white liquor which is formed. The device is furthermore arranged to cool and protect exposed metal surfaces in the separating part without this markedly increasing the contact between the gas phase and the product liquid.

An aspect in one embodiment of the invention using a liquid bath which contacts the outer walls without contacting intermediate walls also achieves a possibility of regulating liquid levels in the separating part which is superior to that of the prior art. This is achieved at the same time as it is readily possible to apply and service measuring and levelling instruments from the outside.

The device according to the invention is defined in Patent Claim 1. According to the invention, the separating part accordingly comprises a first outlet for the phase consisting of solid and/or molten material, which outlet is arranged in connection with the lower part of the reactor part, in the form of a peripheral first outlet which principally follows the circumferential walls of the reactor part, which first outlet leads to the product liquid space, and a second outlet for the phase consisting of gaseous material, which outlet is arranged, in the main, concentrically within the said first outlet. In other words, the separating part possesses a centrally arranged second outlet for the gas phase, which second outlet is arranged such that, outside this outlet, and inside the circumferential walls of the reactor part, there is a first outlet for the phase consisting of solid and/or molten material (the smelt phase), which first outlet consequently encircles the second outlet and leads to the product liquid space.

One aspect of the invention uses the cyclone principle/centrifugal principle for separating the smelt phase and the gas phase from each other, with the device being designed to set the smelt phase and the gas phase in rotation in the reactor part, such that the heavier smelt phase is thrown against the circumferential walls of the reactor part and/or the separating part in order then to be conducted out of the reactor by way of the said first outlet. By contrast, the lighter gas phase is conducted away centrally by way of the said second outlet.

An important aspect of the invention is that rotation should be imparted to the spent liquor and the oxidizing agent in the reactor part as well. In this context, preference is given to the inlet and/or the combustion nozzle for the spent liquor being arranged, in the reactor part, to impart a rotating flow to the gasified spent liquor and the oxidizing agent, preferably by means of the said inlet/combustion nozzle being arranged with oblique spinnerets, or by the inlet/combustion nozzle being arranged to be rotating, or by the said inlet/combustion nozzle being arranged, in the main, tangentially with respect to the reactor part.

According to one aspect of the invention, the exposed metal parts/metal walls in the separating part are cooled and/or protected by being washed with liquid and/or jacketed with cooling liquid. The walls of the second outlet, i.e. for the gas phase, are expediently washed with liquid, both on the outside and on the inside, and/or jacketed with cooling liquid.

According to a preferred embodiment of the invention, the circumferential walls of the reactor part have, in the main, the same cross section, in the horizontal plane, along their principal vertical extent and further on down in a transition to the said separating part having the said first outlet, and also further on down into the lower part of the device. This gives the reactor part, and the device as a whole, an advantageous, in the main straight, shape. A considerable fraction of the reactions also takes place in the separating part, thereby providing an extended reaction space.

According to an alternative embodiment, the circumferential walls of the reactor part have a downwardly, tapering cross section, in the horizontal plane, along their principal vertical extent and further on down in a transition to the said separating part having the said first outlet. This amplifies the cyclone effect in a manner which is advantageous for the separation.

The second outlet, i.e. for the gas phase, can be arranged with an upwardly directed opening or with a downwardly directed opening, as described in more detail below in connection with the figures.

According to one aspect of the invention, the device accommodates both a product liquid space, i.e. a green liquor bath or a white liquor bath in which the smelt phase is dissolved, and a cooling liquid space, i.e. normally a condensate bath through which condensate bath the gas phase is caused to bubble, with the gas phase being washed, cooled and moisture-saturated, and a space for weak product liquid, i.e. a bath containing weak green liquor or weak white liquor in which a relatively small proportion of smelt phase, which is carried by the gas phase into the second outlet, is dissolved. In this connection, the different liquid spaces are preferably arranged at different levels in the device, with intermediate partitions being used for demarcation purposes.

According to one aspect of the invention, the reactor operates at a pressure of 1.5–150 bar (abs), preferably 1.5–50 bar; however, atmospheric pressure is also conceivable. The temperature in the reactor can be 500–1600° C., preferably 900–1100° C.

DESCRIPTION OF THE FIGURES

The invention will be described below in more detail while referring to the figures, of which.

DESCRIPTION OF EMBODIMENTS

Figure 1:
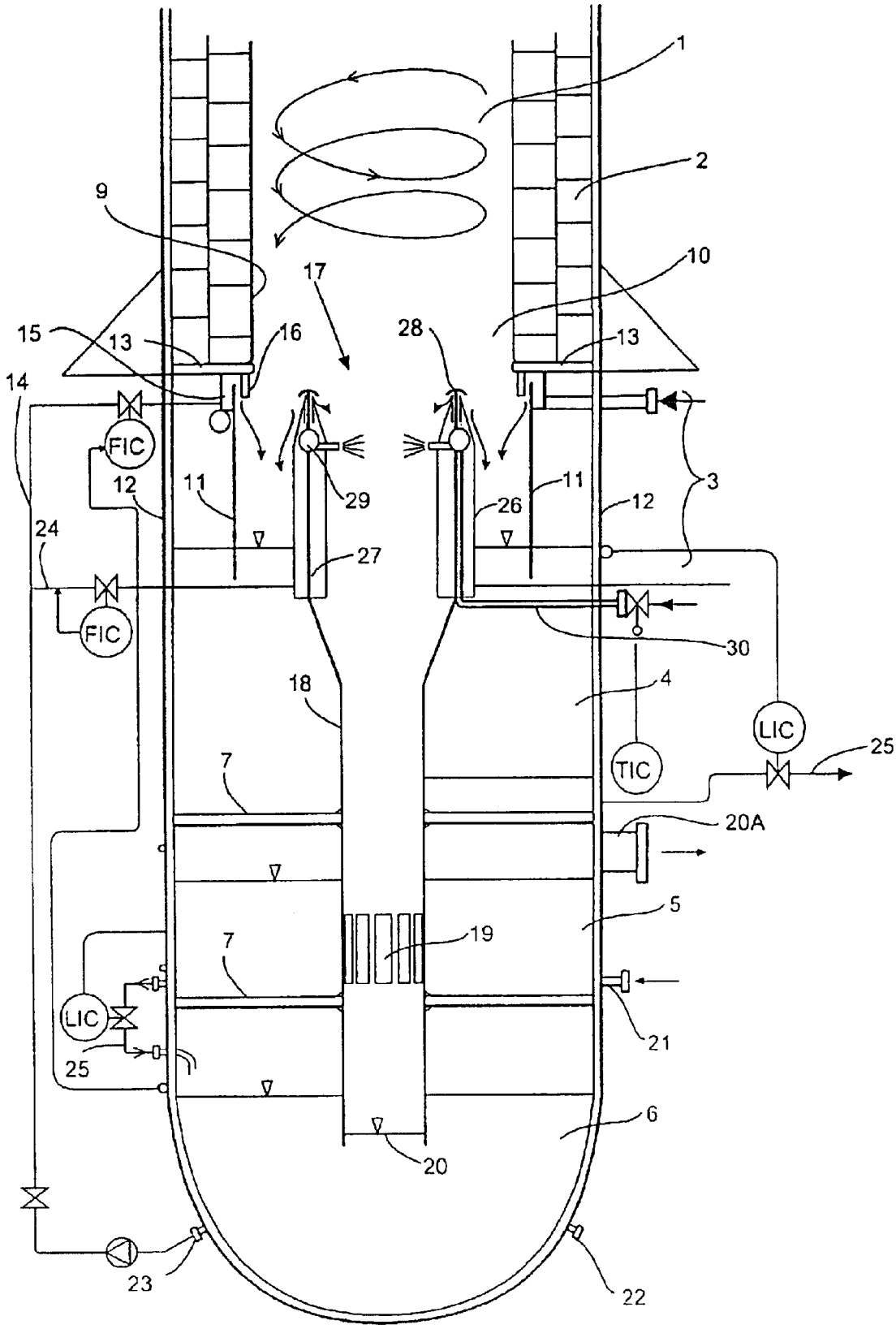
FIG. 1 shows a device according to a preferred embodiment of the invention.

FIG. 1 shows a device in accordance with a preferred first embodiment of the invention, which device is standing and has a mainly circular cross section in the horizontal plane. The device comprises a reactor part 1, having a ceramic lining 2, and a separating part 3. A green liquor space 4, a condensate space 5 and a space for weak green liquor 6 are located under the separating part. In the preferred embodiment, these three spaces are arranged from the top downwards in the said and shown order, together with intermediate partitions 7 which separate them from each other.

The reactor part 1 finishes at the bottom with the same, or in the main the same, open cross sectional area as in its extent at a higher level. The burner 8 (shown in FIGS. 2 and 3) is arranged to impart a downwardly rotating direction of flow, around the walls 9 of the reactor part, to the mixture of smelt phase and gas phase which is formed in the gasification, with the smelt phase coming to be thrown outwards against these walls 9 in order then to run down to a first outlet 10 for the smelt phase. In this connection, the outlet 10 is arranged as a continuation of the circumferential walls 9 of the reactor part 1, with the outlet leading directly down to the green liquor bath/space 4. In addition, a cylindrical metal wall 11, which wall 11 is arranged concentrically within the outer walls 12 of the device, principally as a continuation of the walls 9 of the reactor part, is arranged at the outlet 10. In this connection, the wall 11 is preferably attached at the top to a support arrangement 13 for the ceramic lining of the reactor part, which support arrangement is in turn attached to the outer walls 12 of the device. The wall 11 is arranged to be protected/cooled by means of an external cooling flow 14 of weak green liquor from the space 6 for weak green liquor. Alternatively, it is possible to use a cooling flow in a jacketed construction in a wall 11. The jacketed construction can be constructed of spirally wound pipes which are continuously flushed through with cooling liquid.

This cooling flow 14 is:accordingly caused to flow, by way of a header 15 at the attachment of the wall 11, to the support arrangement 13, over a spillway, having a deflector 16, and down along the inner side of the wall 11 in order to be subsequently collected in the green liquor bath 4. Some of the smelt phase emanating from the reactor part 1 will already become dissolved in this liquid film on the inner side of the wall 11. As a variant, the cooling flow 14 can also consist of a flow from the condensate bath 5 or the green liquor bath 4. The level of liquid in the green liquor space 4 is maintained by means of the cooling flow 14 and an outlet 25 of green liquor, which green liquor is conducted to causticization.

The second outlet 17, for the gas phase, opens out concentrically within the wall 11, or possibly concentrically within the lower part of the circumferential walls 9 of the reactor part. The outlet 17 consists of an upwardly directed opening in a downwardly directed pipe 18, which pipe 18 is arranged to conduct the gas phase down into a cooling liquid space 5. In this connection, the pipe 18 possesses openings/slits 19 at a level with the cooling liquid space 5, through which openings 19 the gas phase can penetrate into the cooling liquid in the cooling liquid space 5 in order to be cooled, washed and moisture-saturated by this cooling liquid. An outlet 20A in the outer wall 12 of the device, which outlet is for the washed gas phase, is arranged to conduct the gas away from the cooling liquid space and the device for the purpose of recovering further energy from the gas. An inlet 21 is arranged for supplying condensate or another cooling liquid. The openings 19 are preferably provided with gate members (not shown), for example in the form of lead-throughs of the water seal type or having non-return valve flaps.

At the bottom, the pipe 18 opens 20 into a space 6 for weak green liquor. A relatively small proportion if smelt phase, preferably at most 10% of the generated smelt phase, which proportion is carried along by the gas phase into the second outlet 17, may possibly fail through the lower opening 20 of the pipe 18 down into the weak green liquor and be dissolved therein. Weak liquor, condensate or another liquid is supplied to the space 6 via an inlet 22, and weak green liquor is conducted via an outlet 23, as the cooling flow 14, to the separating part 3, preferably to the wall 11, for the purpose of cooling and protecting this wall 11. Weak green liquor from the space 6 can also be supplied, 24, to the green liquor space 4 in order to maintain the liquid level balance. The liquid level in the space 6 for weak green liquor can be balanced by supplying, 25, cooling liquid from the cooling liquid space 5.

The diameter of the pipe 18 is somewhat larger at its opening 17 than at its lower part, i.e. the part which leads down to the cooling liquid space 5 and the space 6 for weak green liquor. At its upper part, i.e. in a section connected to the opening 17, the pipe 18 is jacketed both on the outside 26 and on the inside 27. Weak green liquor 24 and/or condensate from the cooling liquid space 5 are supplied to the jacket spaces, as described above, with the weak green liquor/condensate wetting, by way of a spillway 28, the outside and inside of the jacketed section in connection with the opening 17. A cooling/protective film is consequently formed in connection with the opening 17, which protective film flows over the outside and inside of the pipe 18, or more precisely over the outwardly and inwardly facing sides, respectively, of the jackets 26, 27. The jackets 26, 27, like the wall 11, preferably extend right down into the green liquor in the green liquor space 4.

Spray nozzles 29, to which spray nozzles 29 a line 30 for a cooling liquid, preferably a condensate, is connected, are furthermore arranged on the inner side of the pipe 18 in connection with the opening 17. In this connection, the spray nozzles 29 are arranged to spray cooling liquid/condensate into the gas phase, which has flowed from the reactor part 1 through the outlet/opening 17, for the purpose of washing and cooling this gas phase.

Figure 2:
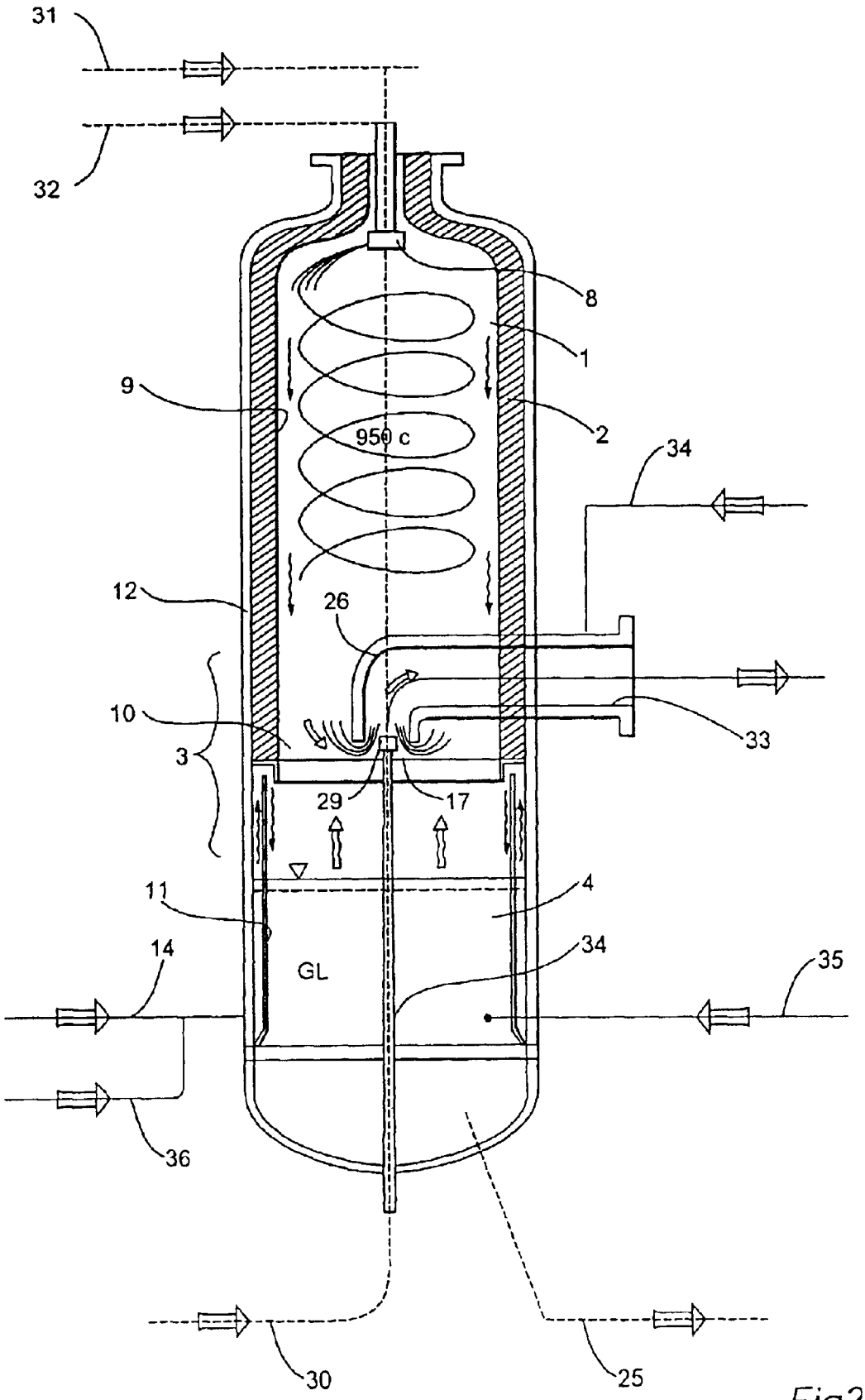
FIG. 2 shows a device according to an alternative embodiment of the invention.

FIG. 2 shows an alternative, second embodiment of the invention. Lines for spent liquor 31 and an oxygen-containing gas 32 are connected to the burner 8. The burner 8 which is shown is provided with a combustion nozzle which, as an alternative, can be arranged to rotate such that a rotating flow downwards in the reactor part 1 is imparted to the gasified spent liquor. Preference is also given to the oxidizing gas 32 also being added in such a way that it is imparted a rotating flow in the reactor part.

A pipe 33 is arranged with a downwardly directed opening 17, which opening constitutes the outlet for the gas phase from the reactor part 1. Where appropriate, an in the main horizontal deflective screen (not shown) can be arranged under the opening 17, which screen assists in directing the gas flow towards the opening 17. A lance 34, possessing a spray nozzle 29 for a liquid for cooling the gas, protrudes into the opening/outlet 17. The pipe 33 is directed upwards and turns off some distance after its opening 17 in order to continue out through the outer walls 12 of the device, with the gas phase preferably being conducted to additional washing/cooling/moisture-saturating and onwards to energy recovery (not shown). The pipe 33 is preferably jacketed, 26, with a cooling liquid/condensate being arranged to be supplied to the jacket space via a line 34.

Figure 3:
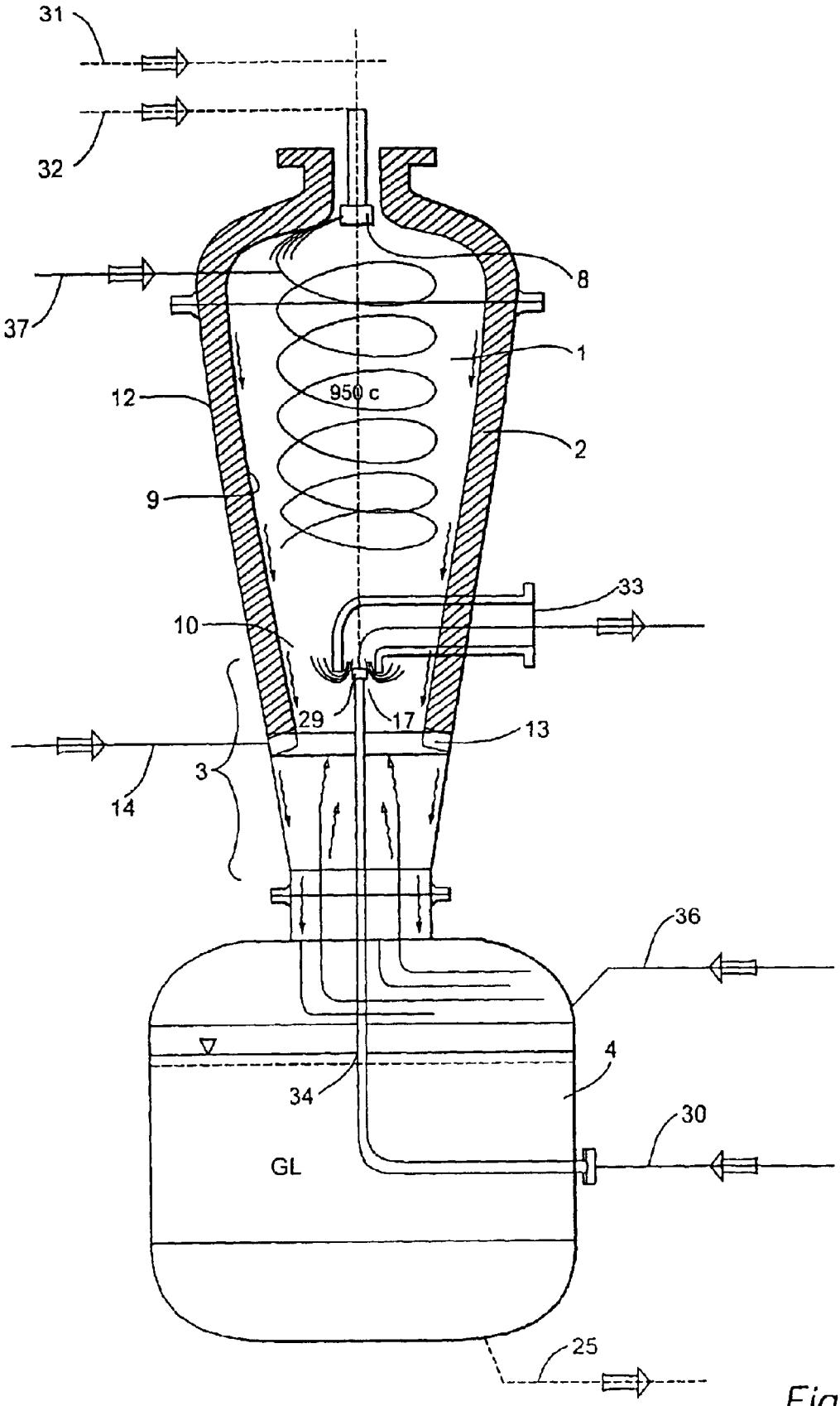
FIG. 3 shows a device according to yet another alternative embodiment of the invention.
Figure 4:
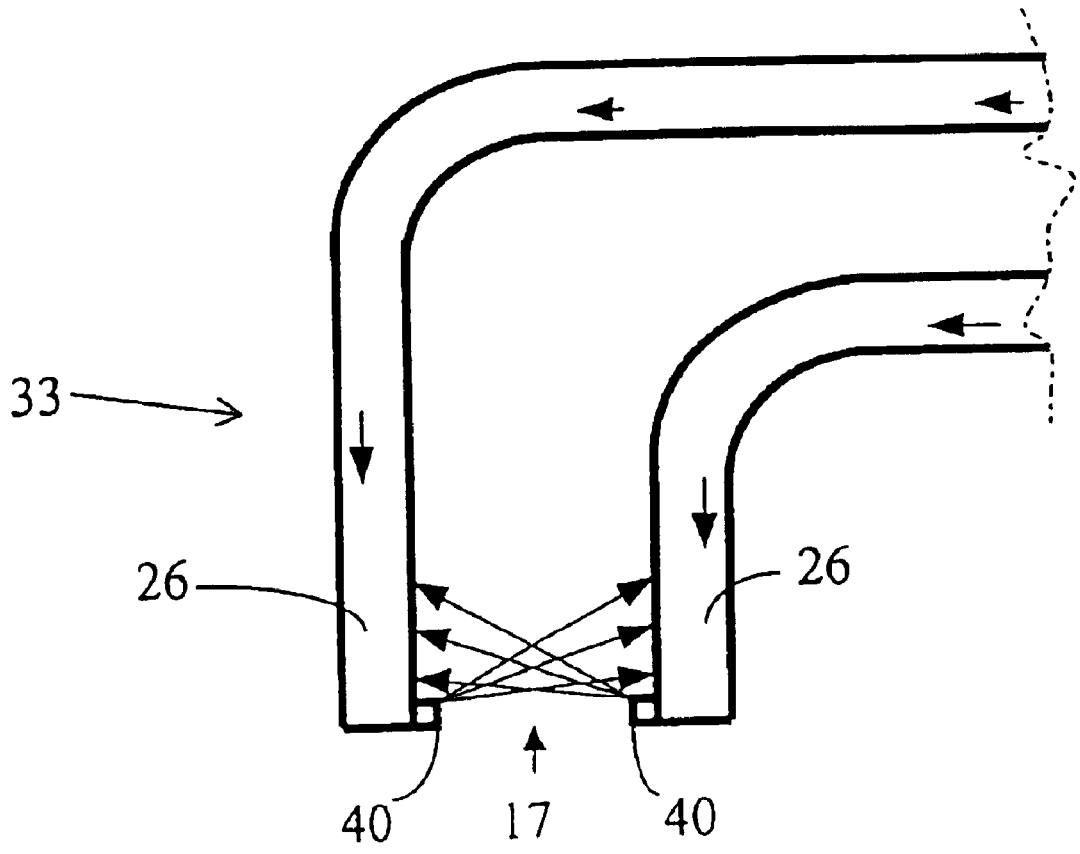
FIG. 4 shows a detailed design of a gas extracting pipe which is suitable for the embodiment shown in FIGS. 2 and 3.

FIG. 4 shows a suitable embodiment of the jacket, 26, pipe 33. In this figure, cooling medium is supplied in the double jacketing, and cooling medium is directed, via nozzles which are arranged internally of the lower part of the opening 17, against the inside of the pipe. When such an arrangement is used, any lances 34 in accordance with FIGS. 2 and 3 can be entirely dispensed with.

The outlet 10 for the smelt phase is arranged to encircle, peripherally within the walls 2, 11 of the reactor part, the outlet 17 for the gas phase. In this connection, the smelt phase, which is thrown by the centrifugal force against the walls 2, 12, flows via the outlet 10 down into a green liquor space 4. An inlet 35 for weak liquor, water or condensate is connected to the green liquor space 4.

In this embodiment as well, the separating part 3 is provided with a cylindrical wall 11 which is arranged concentrically within the outer walls 12 of the device. However, in the embodiment shown in FIG. 2, the wall 11 constitutes an internal jacketing of the outer walls 12, with a cooling flow 14 being arranged to fill the space between the outer walls 12 and the wall 11 in order to flow, via a spillway, out over the side of the wall 11 facing inwards such that this side is washed with a cooling/protective and smelt-conveying liquid film. The cooling flow 14 preferably consists of a condensate, a weak liquor or a green liquor, with a condensate being most preferred.

The surface of the green liquor bath in the green liquor space 4 can be protected with an inert gas, for example $N_2$, which can also be supplied, 36, via the jacket space between the outer walls 12 and the wall 11. In this context, the purpose of the inert gas is to prevent contact between the gas phase, in particular its content of $CO_2$, and the green liquor which has been formed.

In the embodiment shown in FIG. 2, any cooling liquid bath or similar device (not shown) for washing/cooling/moisture-saturating the gas phase, and any space (not shown) for weak green liquor, are arranged outside the vessel for the reactor part 1, the separating part 3 and the green liquor space 4.

FIG. 3 shows a device according to a third embodiment of the invention. In this embodiment, the reactor part has been given a shape which tapers in the downwards direction, like an upside-down truncated/lopped core, an arrangement which amplifies the cyclone effect and improves the separation of the gas phase from the smelt phase. The construction is also advantageous since the ceramic lining 2 becomes in the main self-supporting. The green liquor space 4 is preferably accommodated n a separate vessel, which is connected to the reactor part 1 at the outlet 10 for the smelt phase. The outer walls 12 of the device are cooled/protected in the separating part by a cooling flow 14, which is supplied at the support arrangement 13, or by a cooling arrangement corresponding to the overrun 11, 14 shown in FIG. 2. It can be seen from FIG. 3 that liquid-washed metal surfaces and jacketings at the outlet 17 for the gas phase can be dispensed with in some cases. However, the preferred option is to cool/protect exposed metal surfaces, for example in accordance with FIGS. 1 and 2. The embodiment shown in FIG. 3 is otherwise like that shown in FIG. 2.

FIG. 3 also indicates an alternative position 37 for adding spent liquor and oxygen-containing gas when the inlet for these is arranged tangentially.

Figure 5:
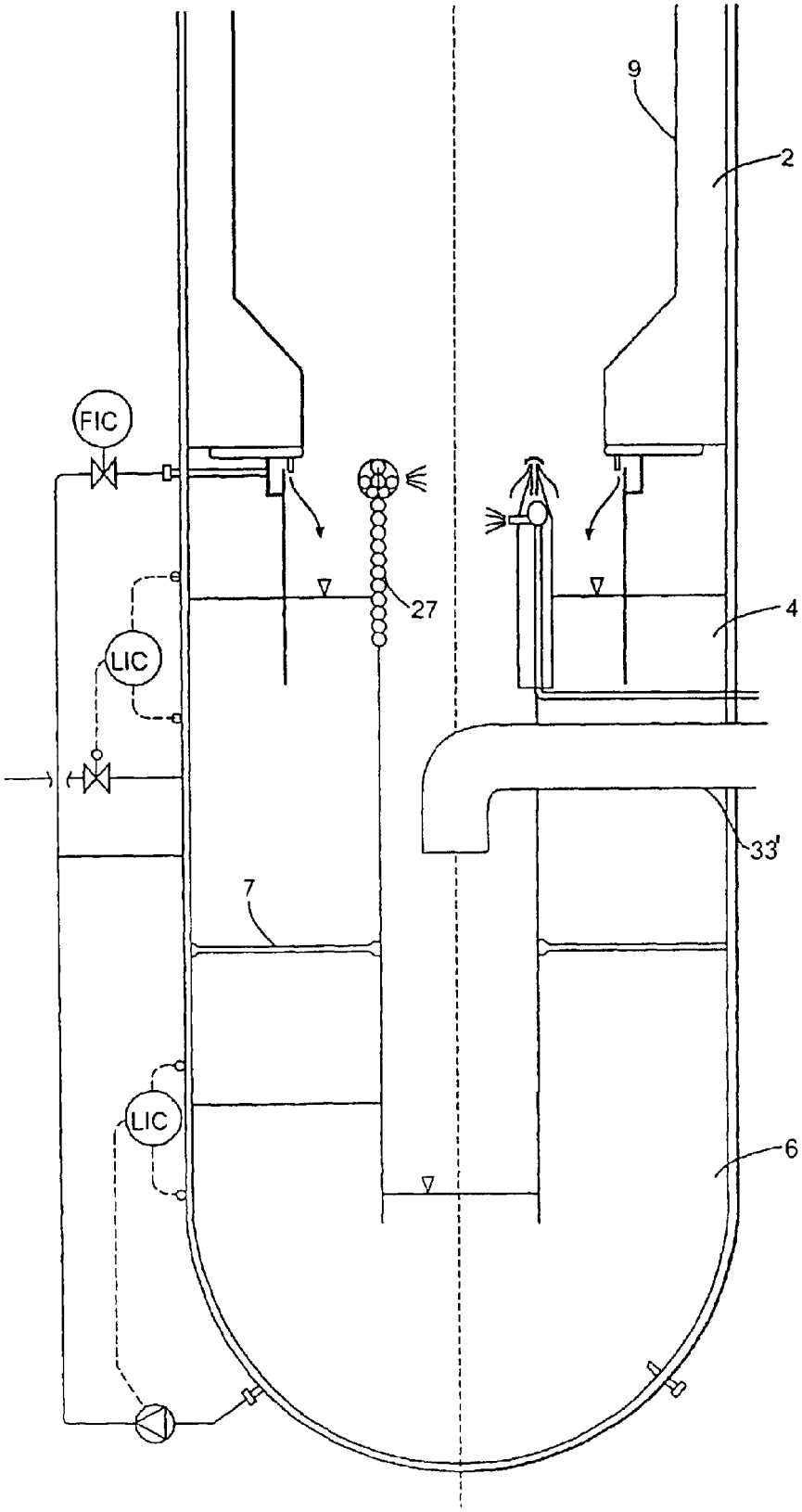
FIG. 5 shows a variant of FIG. 1.

FIG. 5 shows a variant of the embodiment shown in FIG. 1. In this variant, the central gas extraction takes place using an arrangement 33' corresponding to the extraction pipe 33 in FIGS. 2–4. In addition, the figure shows a variant of the jacketed cooling, in this case in the form of pipe coils, on one half 27' of the wall (with the other wall 26 not shown jacketed for comparison).

An important feature of the embodiments shown is that the liquid film 11 which is formed provides many functions, namely;

that of cooling the wall 11, that of wetting the wall 11, thereby preventing coating with the superheated smelt, that of providing protection against corrosion, that of permitting quenching of the smelt phase, that of dissolving the smelt phase, and that of conveying the smelt phase.

In the embodiments shown, it is also important that the separating part constitutes an integral part of the reaction space—i.e. a separation of the smelt takes place at essentially full operating temperature, or with the reaction equilibria being unchanged, resulting in the composition of the smelt inside the reaction space being the same as in the product bath which collects the smelt.

The invention is not limited to the above-described embodiment and can be varied within the scope of the subsequent patent claims. The device can, for example, also be used in connection with the understoichiometric gasification of spent liquors other than conventional black liquor, for example sulphite spent liquors, bleaching department spent liquors or potassium-based black liquor. Furthermore, the green liquor bath can be replaced with a white liquor bath when the process is designed for avoiding causticization and instead producing a white liquor of high sulphidity directly, for example in accordance with WO 91/08337 or EP 617 747.

Moreover, applicable parts of the embodiments shown in FIGS. 1, 2 and 3 can be combined with each other to give rise to additional embodiments. For example, one variant can be a device which has a downwardly directed pipe 18 for the gas extraction, as in FIG. 1, but which lacks the spaces 5 and 6, in the same way as in FIGS. 2 and 3. In the embodiments shown in FIGS. 2 and 3, the ceramic lining 2 of the reactor part can, as a variant, be terminated above the exit of the pipe 33 from the device.

The ceramic linings 2 indicated on the drawings can also be replaced with an indirectly cooled wall for solidifying the smelt against the wall, such that a protective coating is built up on the inner side of the wall.

What is claimed is:

1. Device for the understoichiometric gasification of spent liquor from chemical pulp production, which device comprises an upper reactor part, which upper reactor part is provided with an Inlet having a nozzle for combusting the spent liquor, a separating part for separating a phase, which is formed in the gasification, comprising solid and/or molten material from a phase comprising combustible gaseous material, and also a product liquid space, wherein said separating part comprises a first outlet for said phase comprising solid and/or molten material, which outlet is arranged in connection with the lower part of the reactor part in the form of a peripheral first outlet which in the main follows the circumferential walls of the reactor part, which first outlet leads to said product liquid space, and also a second outlet for said phase comprising gaseous material, which outlet is in the main arranged concentrically within said first outlet, and in that said second outlet comprises an opening of a pipe which is in the main upwardly directed in connection with the opening.

2. Device according to claim 1, wherein said Inlet and/or said nozzle for combusting the spent liquor is arranged to impart a rotating flow, in the reactor part, to the gasified spent liquor.

3. Device according to claim 1, wherein at least one liquid-spraying nozzle is arranged in, or in connection with, said second outlet.

4. Device according to claim 1, wherein said first said second outlet is/are arranged to have liquid-washed walls at least on the inner side of the walls of the outlet.

5. Device according to claim 1, wherein said second outlet is arranged to have liquid-washed walls.

6. Device according to claim 1, wherein said first and/or second arranged to have jacketed walls, with a cooling liquid flow being arranged to be connected to the jacket.

7. Device according to claim 6, wherein the pipe, which is upwardly directed in connection with the opening, changes into a pipe bend for subsequent discharge of the gas phase through the wall of the reactor part.

8. Device according to claim 6, wherein nozzles for washing the inner side of the pipe with cooling media supplied via the jacket we arranged in the opening.

9. Device according to claim 1, wherein the circumferential walls of the reactor part have in the main the same cross section, in the horizontal plane, along their principal vertical extent and further on down in a transition to said separating part having said first outlet.

10. Device according to claim 1, wherein the circumferential walls of the reactor part have a downwardly tapering cross section, in the horizontal plane, along their principal vertical extent and further on down in a transition to said separating part having said first outlet.

11. Device according to claim 1, wherein said second outlet comprises an opening of a pipe which is in the main downwardly directed from the opening.

12. Device according to claim 11, wherein said second outlet is arranged to conduct the gaseous material down into a cooling liquid space.

13. Device according to claim 12, wherein said second outlet is arranged to conduct a relatively small proportion of solid and/or molten material, which material is carried along with the gaseous material into the said second outlet, down into a space for weak product liquid.

14. Device according to claim 5, wherein said second outlet is arranged to have liquid-washed walls with liquid-washing on both the outer side and the inner side of the walls.

15. Device according to claim 12, wherein said second outlet is arranged to conduct the gaseous material down into a cooling liquid space, which cooling liquid space is located below said product liquid space and delimited from this latter space by means of an intermediate partition in the device.

16. Device according to claim 13, wherein said second outlet is arranged to conduct a relatively small proportion of solid and/or molten material, which material is carried along with the gaseous material into the said second outlet, down into a space for weak product liquid, which space for weak product liquid is located below the said cooling liquid space and delimited from this latter space by means of an intermediate partition in the device.

* * * * *